US005868628A

United States Patent [19]

Drobnis et al.

[11] Patent Number: 5,868,628

[45] Date of Patent: Feb. 9, 1999

[54] LIVE-ACTION THEATER

[75] Inventors: Nicholas H. Drobnis; Norman J. Kahn; Randall G. Novak, all of Universal City; Scott H. Smith, North Hollywood; Thomas A. Garcia, Jr., Burbank; David MacMurtry, Alhambra; Robert A. MacDonald; Christopher Brown, both of Moorpark, all of Calif.

[73] Assignee: Universal City Studios, Inc., Universal City, Calif.

[21] Appl. No.: 872,442

[22] Filed: Jun. 10, 1997

Related U.S. Application Data

[63] Continuation of Ser. No. 725,133, Oct. 2, 1996, abandoned.

[51] Int. Cl.[6] ..... A63J 5/02

[52] U.S. Cl. ..... 472/81; 472/75; 472/83

[58] Field of Search ..... 472/57, 59, 60, 472/75, 81, 83, 136, 137

[56] References Cited

U.S. PATENT DOCUMENTS 3,754,756 8/1973 Szigety ..... 472/75

4,431,182 2/1984 Reynolds ..... 124/26 X 4,583,743 4/1986 Macek ..... 273/368

4,798,476 1/1989 Trumbull et al. ..... 472/60

*Primary Examiner*—Klen T. Nguyen

*Attorney, Agent, or Firm*—Lyon & Lyon LLP

[57] ABSTRACT

In a live-action theater, a catapult launches a prop which achieves free flight in the theater. The catapult and prop are concealed until the moment of launch, whereupon the prop suddenly hurtles into an audience's view, and lands in front of the audience. The audience views the launch from a seating area or from a vehicle moved through the theater. The prop is for example, a seaplane or a jetski. The prop is then retrieved from the landing area using a crane or other lifter and returned to the catapult for a subsequent launch. By launching a prop in a theater with a catapult, the audience sees true free flight, rather than an illusion of flight. The audience sees no supports or other devices which can diminish the effect. A catapult allows a prop to be launched directly at the audience at a realistic or full speed, creating a more dramatic effect than if a prop is moved about some distant stage area using cables or a boom.

13 Claims, 8 Drawing Sheets

LIVE-ACTION THEATER

This is a continuation of Application Ser. No. 08/725,133, filed Oct. 2, 1996 now abandoned.

BACKGROUND OF THE INVENTION

The present invention relates to the entertainment industry, particularly to live theater and ride attractions where an audience watches a live-action show typically involving stunts. Live-action shows have become increasingly popular, for example, at amusement or theme parks. These types of shows are becoming increasingly sophisticated in the special effects and stunts involved, which audiences have come to expect.

Many of the theaters offering such shows try to incorporate stunts similar to those seen in motion pictures and television shows. In the film industry, vehicles often fly through the air as part of an action sequence. The film's story may require a prop, such as a car or a boat, to hurtle through the air, or may require that an object explode and be thrown like a projectile.

Film makers have used several different means to achieve the illusion of free flight. For example, the industry often achieves these stunts by using a catapult or other means for launching a prop into the air. The catapult is hidden from view of the camera, or is simply edited out of the film by filming the launch from several vantage points and eliminating those shots that expose the catapult to view. Generally this method is destructive, and requires multiple props for multiple shots.

The motion picture industry also simulates free flying vehicles or other objects using tethers. A prop simulating free flight can be supported by cables, wires, or other similar devices. When the prop is supposed to "fly," the cables raise the prop up off the ground and move it in the manner desired. The cables are concealed into the background, or edited out of the film using well known techniques, to maintain the illusion being created.

In a third technique, a prop is mounted on an arm, such as an extending boom. The boom is concealed or incorporated into the set. The prop is then filmed from camera angles which provide the appearance of untethered free movement.

In live theater, however, film techniques often cannot be used. Cables and wires may be difficult to conceal, such that an audience can often see them, diminishing the effect being created. They also require a superstructure above them from which the cables are supported. Usually the roof of the building containing the theater provides this support. Thus indoors, a prop can "fly" out towards an audience, although the possibility of the audience noticing the exposed cables increases as the prop nears them.

If a theater is located outdoors, the use of such cables is even more severely limited. Neither the cables nor their supports can be concealed very effectively. The prop can be kept at a distance from the audience, such as near a stage area, reducing, but not eliminating, the possibility of the audience noticing the cables.

A boom-like device may be used in outdoor theaters more effectively than cables. However, a boom can only be viewed from a few angles to maintain the effect of flight. Otherwise the boom becomes visible to the audience, destroying the illusion. To minimize this impact, the boom can be concealed, such as mounting it behind a stage or a wall, although this positioning requires the prop to "fly" only near the scenery used to conceal the boom. The prop cannot fly out towards the audience without the boom becoming exposed to view. Generally, in the repetitive environment of live action shows, the prop cannot achieve full speed due to the excessive loads imparted on the support equipment.

Accordingly, there is a need to better create the appearance of free flight in a live-action theater, without using devices which detract from the effect being created.

SUMMARY OF THE INVENTION

To these ends, the present invention uses a catapult or similar launcher for a prop in a live-action theater. An audience in the theater can view the launch of the prop without having the effect diminished by extraneous devices, such as cables or boom arms. Thus by launching a prop in a theater with a catapult, the appearance of free flight is created in a theatrical setting by true free flight, rather than by an illusion of flight. Preferably, a catapult allows a prop to be launched directly at the audience, creating a significantly more dramatic effect than if a prop is moved about some distant stage area by cables or a boom. The catapult and the prop are advantageously concealed from the audience until the moment in the show when the prop is launched. The prop then suddenly flies into the audience's view, achieving free flight before landing in the viewing area at full speed, and without damage. Preferably, a pyrotechnic display, such as a flame cannon, explosions and other effects, contribute to the effect of the prop being suddenly launched into view, free flying before the audience.

The audience viewing area may include a stadium into which the audience enters, sits and watches the prop fly into the viewing area during the performance. Alternatively, the seats may be on a vehicle, such as in a tram or other people mover. The audience sitting in the vehicle is transported into the viewing area, watches the prop being launched into the viewing area, and then upon completion of the launch, is transported out of the area.

BRIEF DESCRIPTION OF THE DRAWINGS

In the drawings, wherein similar reference characters denote similar elements throughout the several views.

DETAILED DESCRIPTION OF THE PREFERRED EMBODIMENTS

Figure 1:
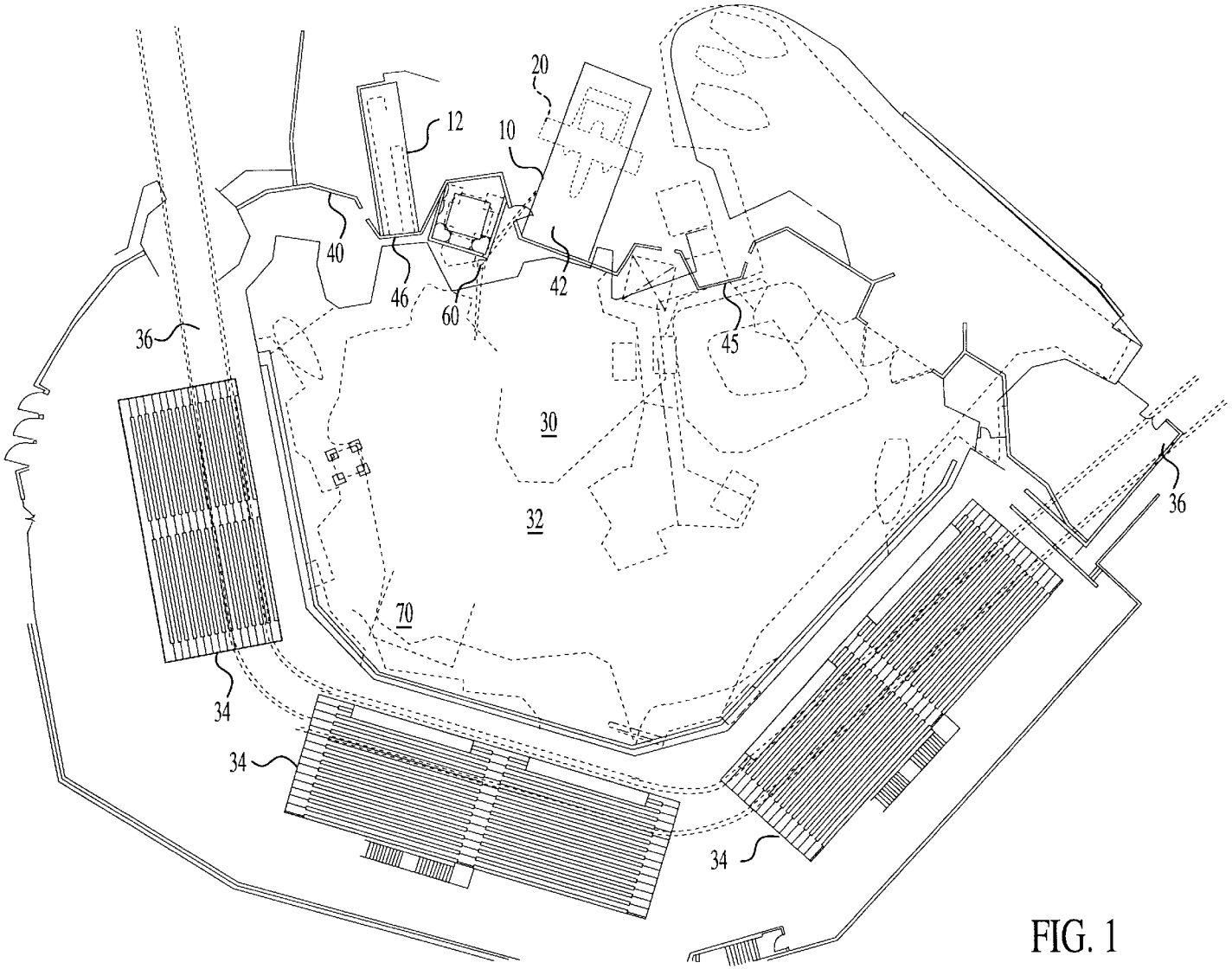
FIG. 1 is a plan view of a preferred embodiment of the live-action theater, including a seaplane catapult, a jetski catapult, and a stadium with a lagoon and an audience seating area.

Turning now in detail to the drawings, as shown in FIG. 1, an audience viewing area 30 includes a lagoon 32 and an audience seating area 34. Alternatively instead of the audience seating area 34, the audience may be seated on a vehicle (not shown) and moved through the theater along a path 36 which passes through the audience viewing area 30. The lagoon 32 is located adjacent to the audience seating area 34 in the audience viewing area 30. Preferably, a scenic wall 40 runs along the edge of the lagoon 32 at the back of the audience viewing area 30. Behind the scenic wall 40, catapults 10 and 12 are mounted. A landing area 70 is placed in the lagoon 32, in front of the audience seating area 34 and in line with the trajectory of the catapult 10 and the prop 20. A crane 60, incorporated into the audience viewing area 30, provides access from the audience viewing area 30 over the scenic wall 40. Break-away panels 42 and 44 are mounted in the scenic wall 40 in front of the catapults 10 and 12 respectively.

Figure 3:
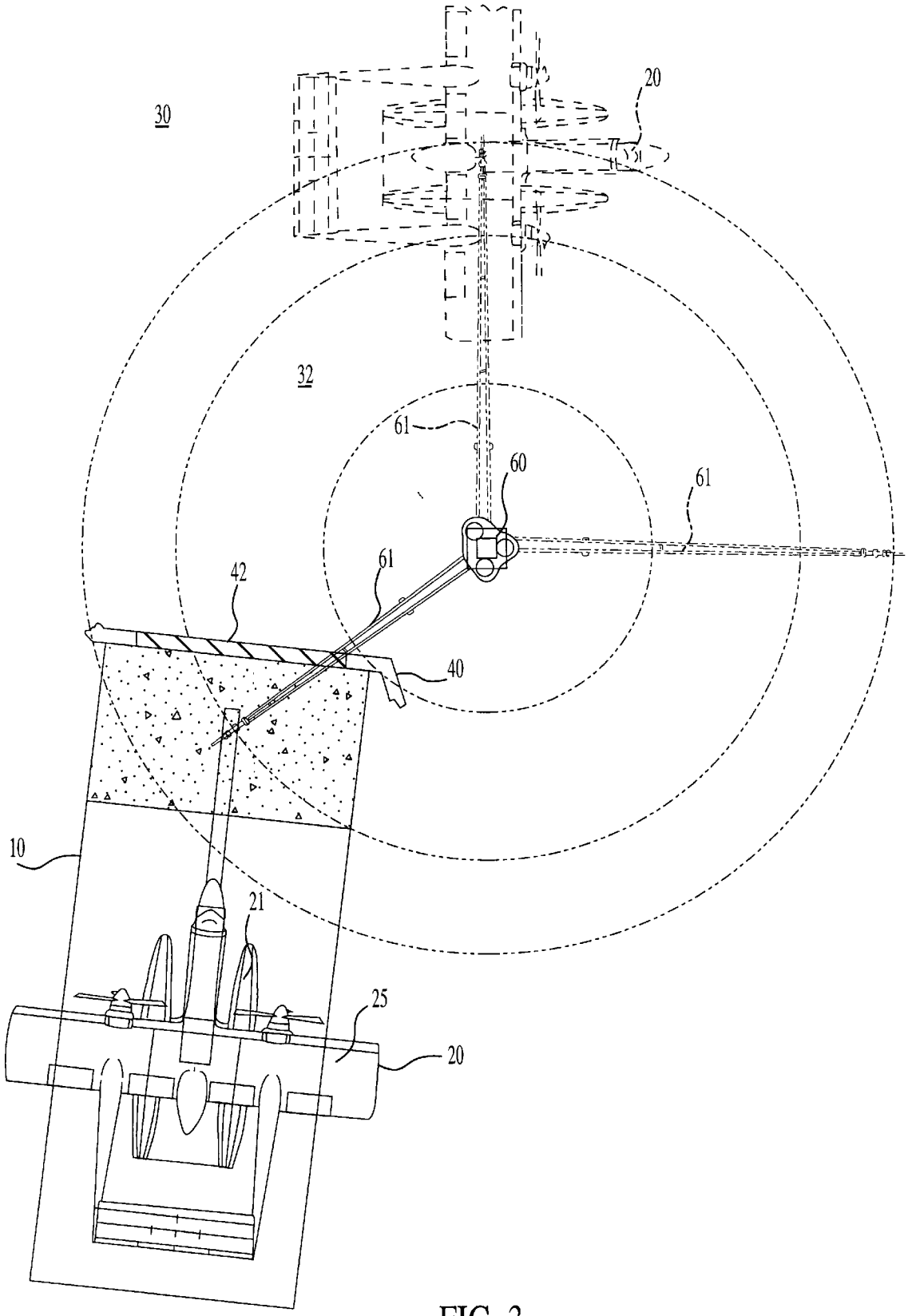
FIG. 3 is plan view of a crane that can be used to return the seaplane to the catapult after it has been launched into the lagoon, depicting the crane at various stages of its operation.
Figure 4:
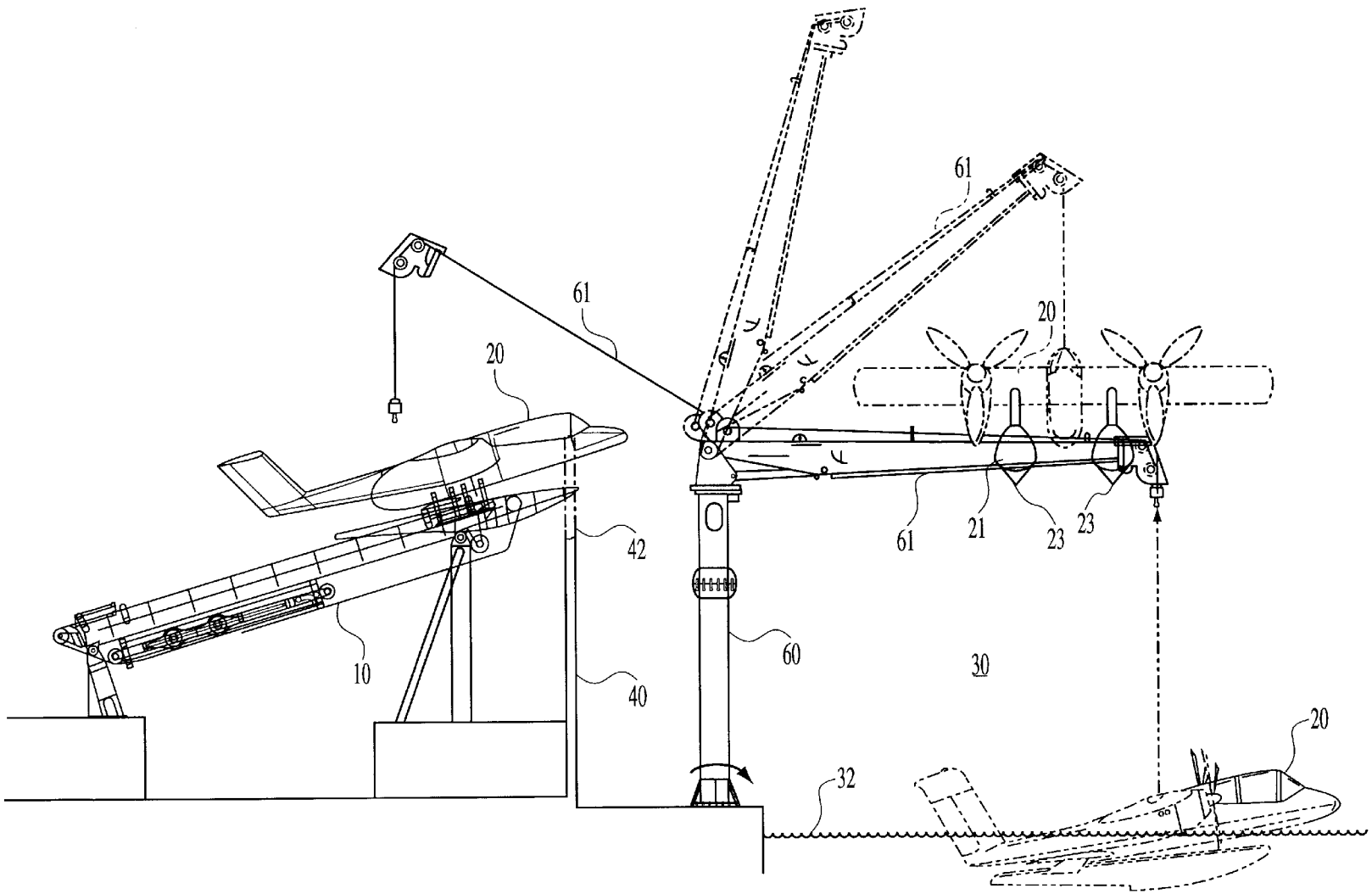
FIG. 4 is a side elevation view of the crane, and showing its use to lift the seaplane up from the lagoon and return it to the catapult.

FIGS. 3 and 4 illustrate, in more detail, the first preferred embodiment of FIG. 1. A catapult 10, oriented towards the audience viewing area 30, is placed behind a scenic wall 40 running along the back of the audience viewing area 30. A seaplane prop 20, also oriented towards the audience viewing area 30, is placed on the catapult 10. One or more break-away panels 42 are mounted into the scenic wall 40 in front of the catapult 10 and the seaplane 20. In front of the scenic wall 40, a lagoon 32 lies in line with the trajectory of the seaplane 20. On the edge of the lagoon 32 near the scenic wall 40, a rotating crane 60 with a boom arm 61 provides access over the scenic wall 40 between the lagoon 32 and the catapult 10.

Figure 5A:
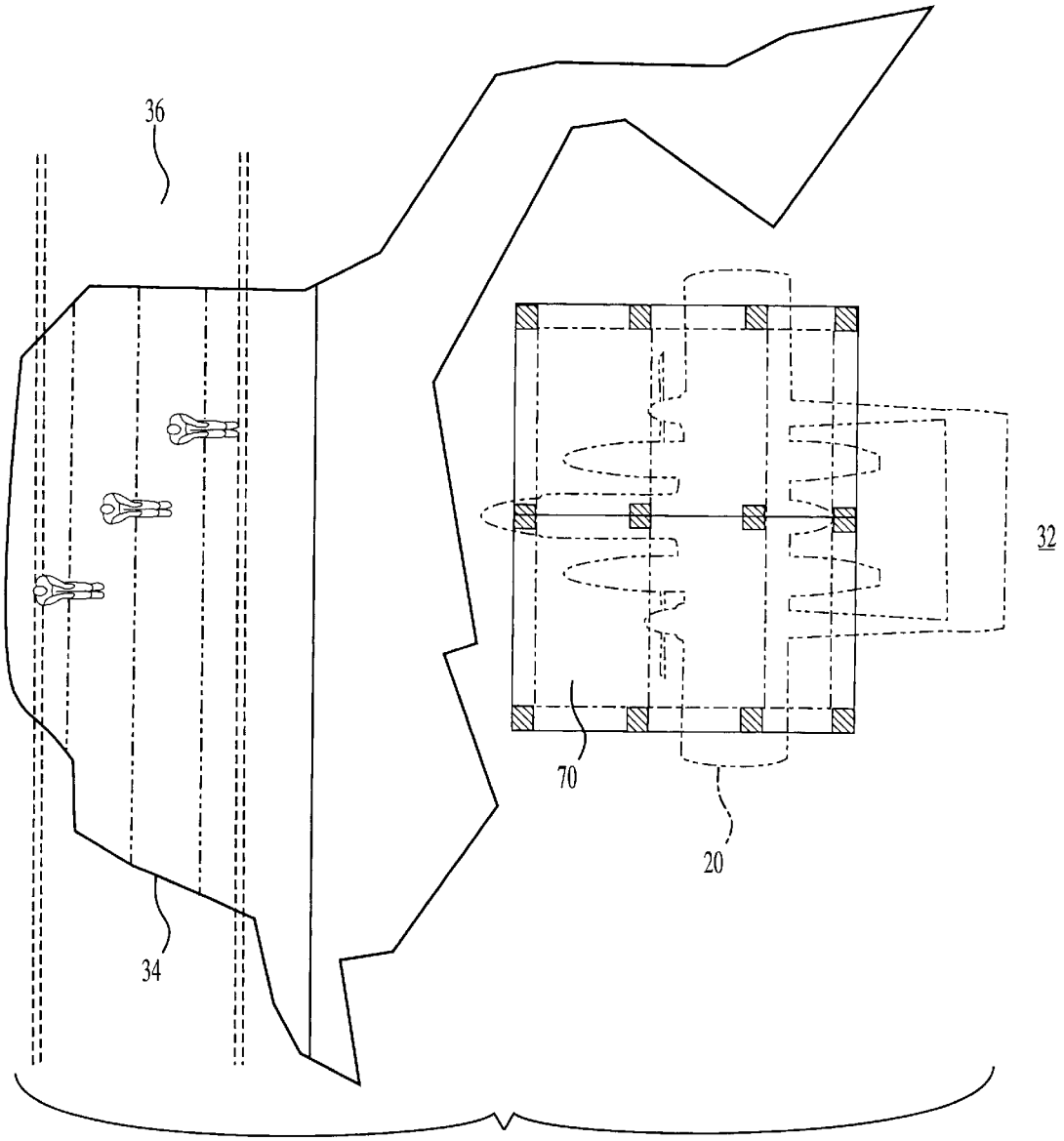
FIG. 5A is a plan view of the prop or seaplane landing area.
Figure 5B:
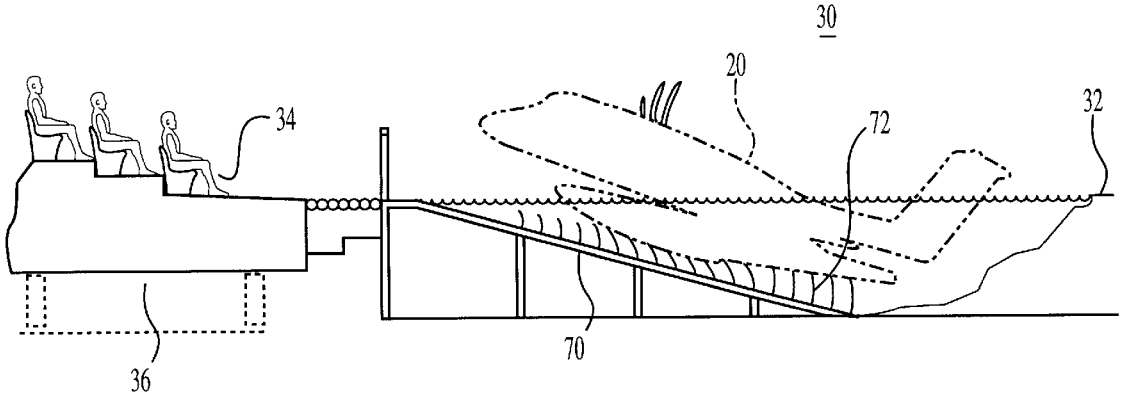
FIG. 5B is a side elevation view thereof.

Turning to FIGS. 5A and 5B, the lagoon 32 also has a landing area 70 for the seaplane 20. The landing area 70 is placed in close proximity to the audience seating area 34 or to the path 36 for a vehicle moving the audience through the audience viewing area 30. Flexible fins 72 are placed below the water's surface in the landing area 70.

Figure 2:
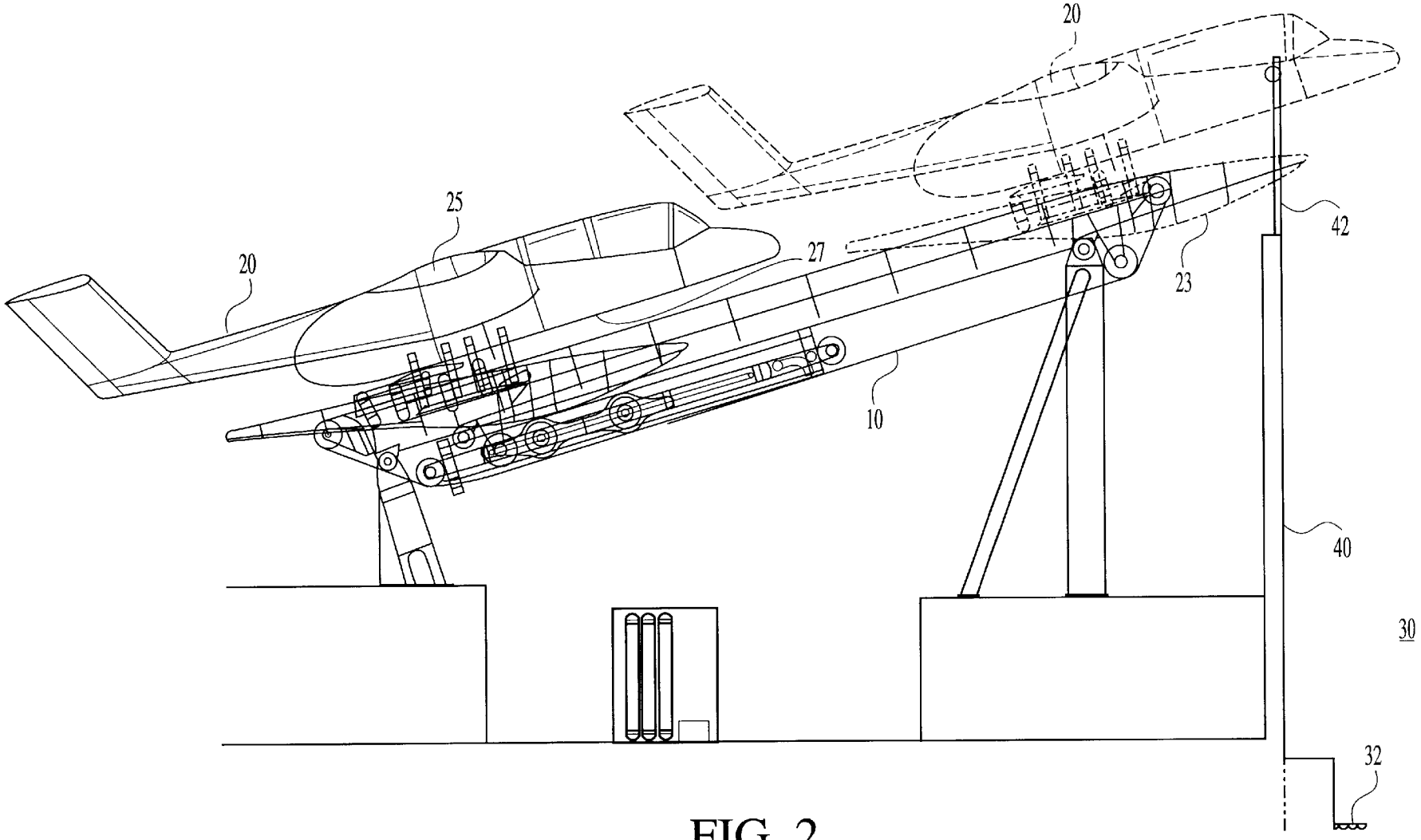
FIG. 2 is a section view of the first preferred embodiment, having a seaplane launched from a catapult through a scenic wall into a lagoon.

FIG. 2 provides detail of the operation of launching the seaplane 20 from the catapult 10. The catapult 10 accelerates the seaplane 20 towards the audience viewing area 30. The break-away panels 42 are mechanically moved out of the way immediately prior to launch or are constructed of an easily broken material that gives way as the seaplane 20 contacts the break-away panels 42, creates an opening and enters the audience viewing area 30. The seaplane 20 then achieves free flight in the audience viewing area 30. The opening preferably appears to have been created by an explosion or collision. The breakaway panels 42 are mounted to drop down or rise up, or to hinge or swing out of the way, to allow the seaplane 20 or other prop and/or stuntmen, to pass. The breakaway panels 42 are advantageously controlled by a show controller interlocked with the launch mechanism.

Returning to FIGS. 5A and 5B, the seaplane 20 lands in the landing area 70 in the lagoon 32 in front of the audience seating area 34. The flexible fins 72 in the landing area 70 slow the seaplane 20 down when it lands in the lagoon 32, such that the seaplane 20 comes to rest in front of the audience seating area 34.

As shown in FIGS. 3 and 4, after the performance, the crane 60 can be rotated until the boom arm 61 is positioned over the seaplane 20 sitting in the lagoon 32. The boom arm 61 then latches onto the seaplane 20 and lifts it up out of the lagoon 32. The crane 60 is then rotated around until the seaplane 20 passes over the scenic wall 40 and break-away panels 42 and is in position over the catapult 10. The boom arm 61 then lowers the seaplane 20 onto the catapult 10 which is then prepared for the next launch. Alternatively, lift trucks, carts or other movers may be used. The crane 60 is preferably incorporated into the set via other props, paint, camouflage, etc., so that it is not noticeable as a crane during the performance.

Figure 6:
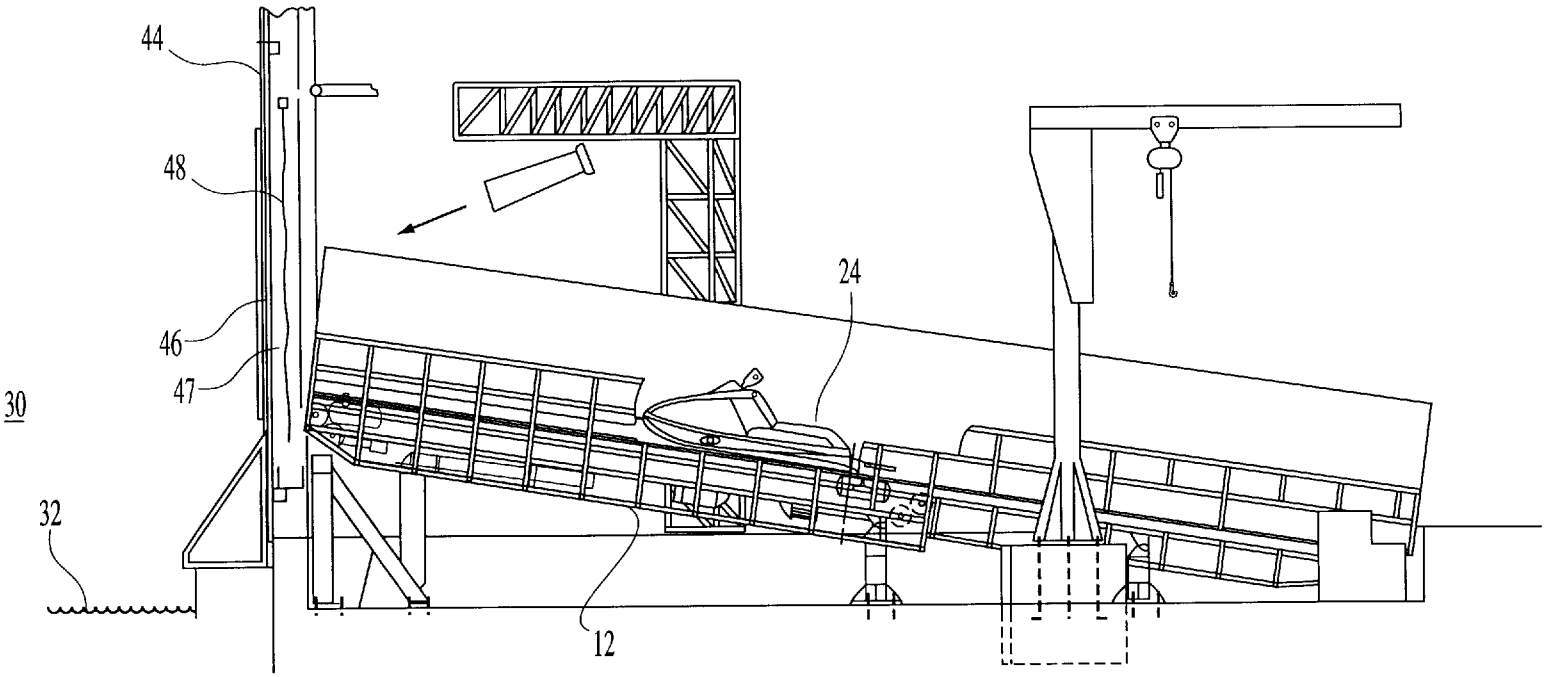
FIG. 6 is a side elevation view of a second preferred embodiment, having a jetski launched from a catapult.
Figure 7:
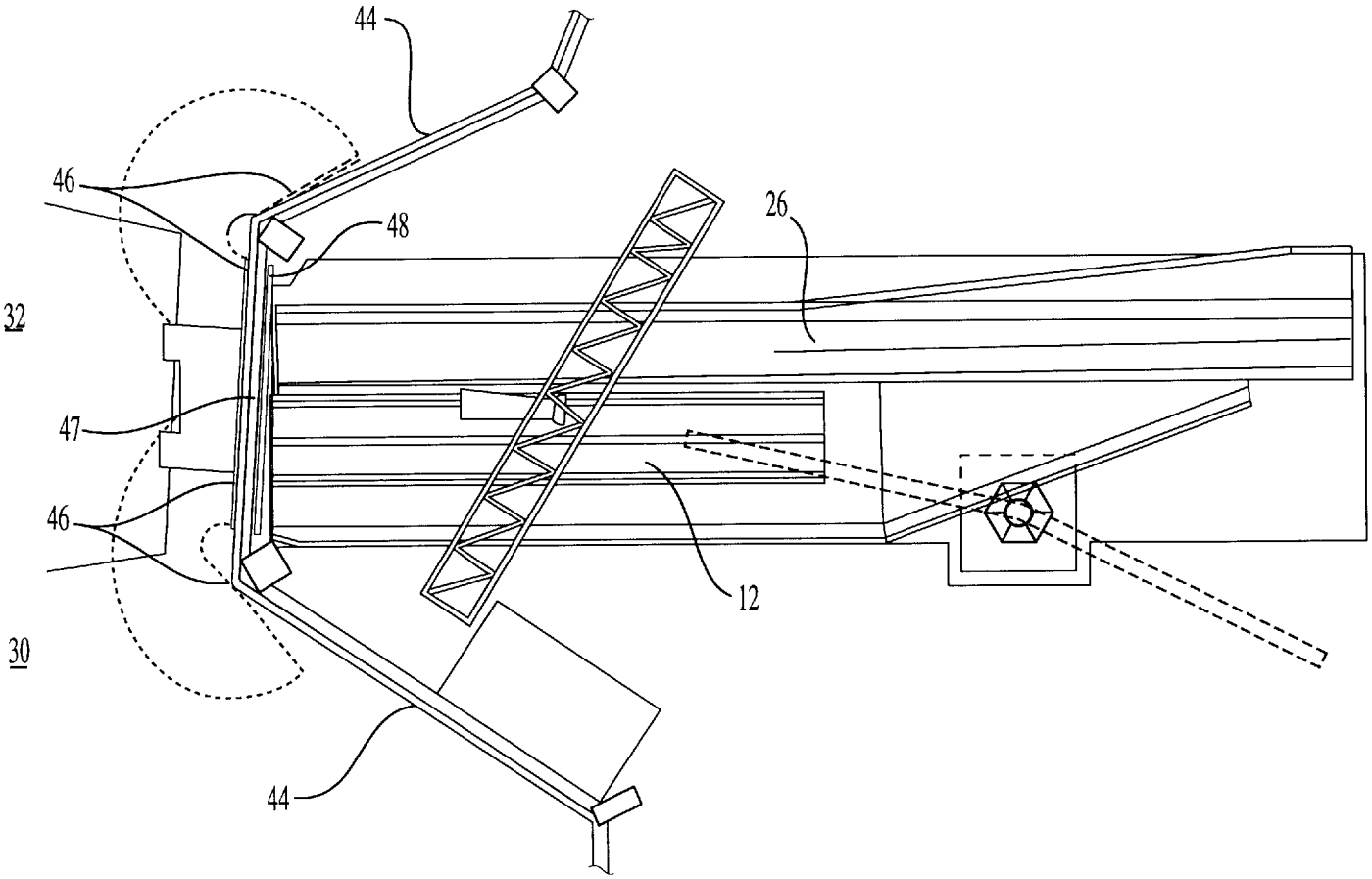
FIG. 7 is a plan view of the jetski catapult, including break-away panels used to conceal the jetski prior to launch.

Referring now to FIGS. 6 and 7, the second preferred embodiment of FIG. 1 is presented in detail. A catapult 12, oriented towards the audience viewing area 30, is installed behind a scenic wall 44 running along the back of the audience viewing area 30. A jetski 24 with a rider (not shown), also oriented towards the audience viewing area 30, is placed on the catapult 12. In addition, a ramp 26 may be placed adjacent to the catapult 12 for a water skier (not shown) being towed by the jetski 24. In front of the scenic wall 44, a lagoon 32 lies in line with the trajectory of the jetski 24.

One or more break-away panels 46 are mounted in the scenic wall 44 in front of the catapult 12 and the jetski 24, covering an opening 47 in the scenic wall 44. A masking drop 48 also covers the opening 47. Turning to FIG. 8A, the break-away panels 46 are shown closed, covering the opening 47 in the scenic wall 44. A flame cannon 50 is placed in front of the scenic wall 44 below the opening 47.

Figure 8B:
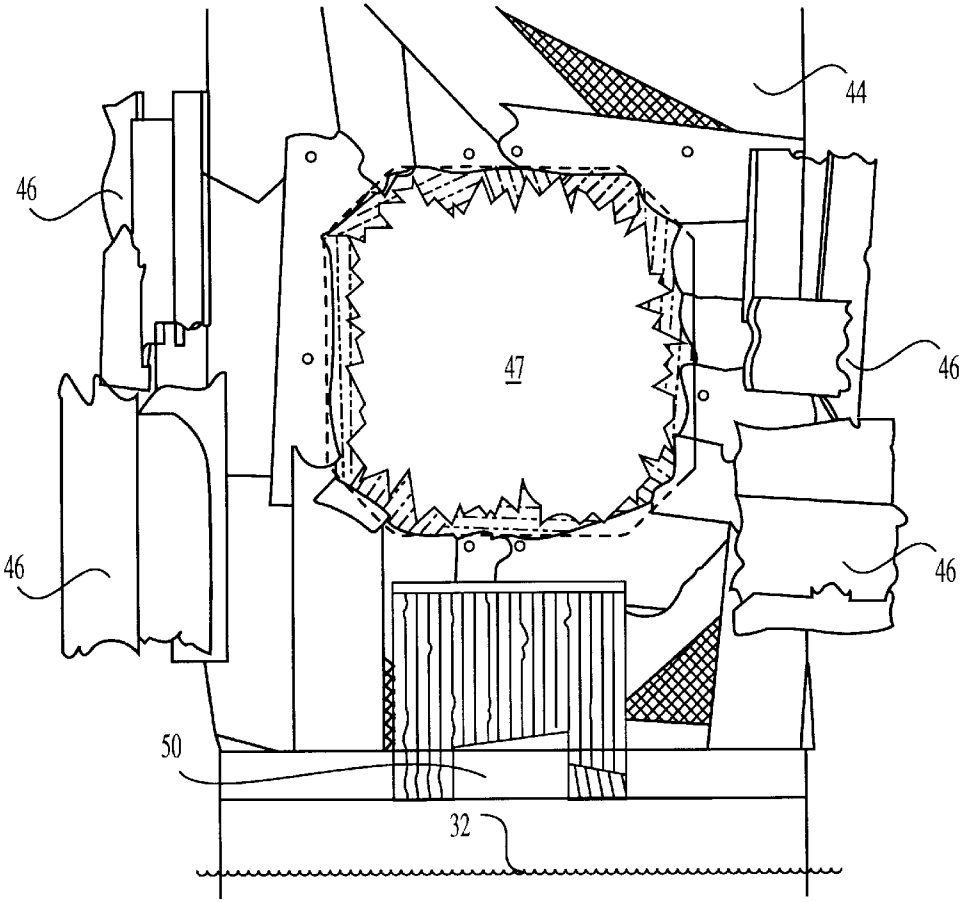
FIG. 8A and 8B are schematic views of the break-away panels for the jetski launch area, illustrating the panels in both the closed position prior to launch and in the open position during launch, respectively.
Figure 8A:
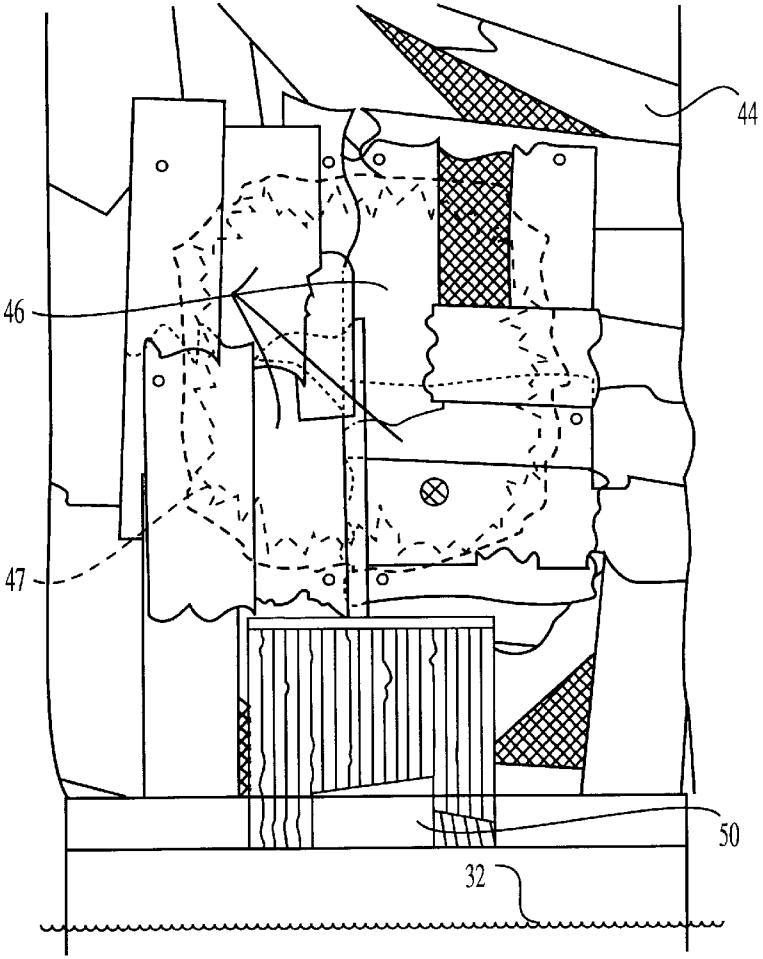

As shown in FIG. 8B, during operation, the break-away panels 46 are opened mechanically prior to launch, exposing the opening 47 in the scenic wall 44. Alternatively, the break-away panels 46 are constructed from a material that breaks easily upon contact with the jetski 24 being launched through the opening 47 and thus remain in place when the jetski 24 is launched. The flame cannon 50 provides a pyrotechnic display which conceals the movement of the break-away panels 46 as they are opened and conceals the opening 47. The masking drop 48 further covers the opening 47 and conceals the catapult 12 and jetski 24 once the break-away panels 46 are opened. Once the break-away panels 47 are opened, the jetski 24 may be launched.

Turning once again to FIGS. 6 and 7, during launch, the catapult 12 accelerates the jetski 24 towards the audience viewing area 30. The masking drop 48 is moved out of the way or is penetrated by the jetski 24. The jetski 24 enters the audience viewing area 30 through the opening 47 in the scenic wall 44 and achieves free flight before landing in the lagoon 32. In addition to the jetski 24, a water skier (not shown) may be towed by the jetski 24 when it is launched by the catapult 12. The water skier slides along the ramp 26 following the jetski 24 through the opening 47, and enters the audience viewing area 30, landing in the lagoon 32. The flight distance from launch to touchdown in the preferred embodiment, is about 24 feet, with a launch speed of about 30 ft./sec. The catapults 10 and 12 launch the props at a realistic looking speed. In contrast, using a crane or other mechanical support would require a much slower, and less realistic launch. After the props obtain "free flight", they travel at gravity speed, i.e., they move forward and down at the same speed that an object of its size and shape would travel. The seaplane 20, having broad flat wings and other surfaces, moves at a gravity speed slower than the jetski, which is more streamlined and creates less lift and drag. As the props land on water, they are not damaged (as are launched props in motion picture production) and can be quickly repositioned and reused for the next show.

The pontoons 21 on the seaplane 20, although appearing conventional in design, have sharply angled lower surfaces 23. As the seaplane 20 drops into the water, the surfaces 23 cut into the water more deeply than conventional pontoons. This decreases the impact forces on the seaplane prop 20. The broad flat wing 25 and underside 27 of the seaplane 20 also aerodynamically decrease the rate of fall.

Movement of the panels 46 is advantageously concealed by flame and water effects. The catapults 10 and 12 and launch connections are well known in the motion picture industry for launching props and not separately described here. For example, the catapult 12 may operate with a pneumatic or hydraulic ram in concert with a compound cable mechanism driving a bogie or equivalent.

While the invention is susceptible to various modifications and alternative forms, specific examples thereof have been shown in the drawings and are described in detail. It should be understood, however, that the invention is not limited to the particular forms or methods disclosed. Rather, the invention is intended to cover all modifications, equivalents, and alternatives falling within the spirit and scope of the claims.

We claim:

1. An attraction comprising:

a catapult, an untethered prop on said catapult, an audience viewing area into which said prop is launched from said catapult, such that said prop achieves free flight before landing in said viewing area;

a movable panel for concealing said prop from said viewing area until said prop is launched from said catapult; and means for moving the panel out of the path of the prop.

2. The attraction of claim 1 wherein said prop comprises a seaplane.

3. The attraction of claim 1 wherein the panel conceals an opening in a wall.

4. The ride attraction of claim 3 further comprising a show controller linked to the means for moving, and to the catapult for coordinating movement of the panel with the launch of the prop.

5. The attraction of claim 1 wherein the audience viewing area includes a body of water into which the prop lands.

6. The ride attraction of claim 5 further comprising flexible fins positioned below the water surface.

7. The attraction of claim 1 further comprising a scenic wall positioned in between the catapult and the audience viewing area, with the panel positioned in an opening in the scenic wall.

8. The attraction of claim 7 further comprising a flame cannon in front of the scenic wall and below the panel.

9. An amusement park/theatrical attraction comprising:

a catapult;

an untethered prop on said catapult;

an audience viewing area into which said prop is launched from said catapult, such that said prop achieves free flight before landing in said viewing area; and a pyrotechnic display in between the catapult and the audience viewing area in a position to conceal said prop from said viewing area until said prop is launched from said catapult.

10. The attraction of claim 9 wherein said audience viewing area further comprises means for transporting an audience through said viewing area.

11. The attraction of claim 9 wherein said prop comprises a vehicle and one or more riders.

12. The attraction of claim 11 wherein said prop comprises a jetski.

13. An attraction comprising:

a catapult;

an untethered prop placed on the catapult;

an audience viewing area into which the prop is launched from the catapult, such that the prop achieves free flight before landing in the viewing area; and a frangible panel concealing the prop from the viewing area until the prop is launched from the catapult through the panel.

* * * * *